United States Patent [19]

Achelpohl

[11] 4,199,184

[45] Apr. 22, 1980

[54] LIFTING GEAR FOR FILLED SACKS

[75] Inventor: Fritz Achelpohl, Lengerich, Fed. Rep. of Germany

[73] Assignee: Windmoller & Holscher, Lengerich, Fed. Rep. of Germany

[21] Appl. No.: 899,341

[22] Filed: Apr. 24, 1978

[30] Foreign Application Priority Data

Apr. 26, 1977 [DE] Fed. Rep. of Germany ..... 2718586

[51] Int. Cl.[2] ..... B66C 1/10

[52] U.S. Cl. ..... 294/106

[58] Field of Search ..... 294/106; 214/147 G, 214/147 R, 1 BD, 1 CM

[56] References Cited

U.S. PATENT DOCUMENTS 2,967,632 1/1961 Coates ..... 294/106

FOREIGN PATENT DOCUMENTS 1165829 3/1964 Fed. Rep. of Germany ..... 294/106

*Primary Examiner*—James B. Marbert

*Attorney, Agent, or Firm*—Fleit & Jacobson

[57] ABSTRACT

In lifting gear for filled sacks, a device for engaging a gathered and flattened end of the sack adjacent the mouth thereof comprises two pairs of tongs. A first clamping bar is disposed at the free end of one limb of each pair of tongs and a second clamping bar, parallel to the first, is secured to two links which are pivoted to the free ends of the other limbs. The gathered and flattened end of the sack is introduced between the clamping bars as the open tongs are lowered, whereupon the links are revolved and the tongs are closed so that the end of the sack is slung about the clamping bars.

10 Claims, 3 Drawing Figures

LIFTING GEAR FOR FILLED SACKS

The invention relates to an apparatus for lifting filled sacks, comprising a pair of parallel clamping bars in which the gathered and flattened end of the sack can be inserted to envelop same.

An apparatus of this kind known from U.S. Pat. No. 3,937,394 and in the form of a carrying frame which, however, serves only as a releasable carrying handle for paper bags or like flexible articles, is bent from spring wire and possesses at the side opposite the hand grip a pair of substantially parallel clamping bars of which the ends are bent so that they resiliently embrace the respective other bar. To engage the end of the bag to be carried, the carrying frame is held with its handle downwardly and the end of the bag is placed between the two clamping bars by being slung about the lower clamping bar of the carrying frame in this position. If the hand grip of the carrying frame is now swung upwardly to its carrying position, the end of the bag will be slung about the clamping bars and pull it together to produce a tight clamping connection.

Even if it is correspondingly modified, the known carrying frame is not suitable as a connecting member for suspending heavy filled sacks from the hooks of cranes. This is because a suitable heavy-duty frame hanging from the hook of the crane would have to be lifted to enable the end of the sack to be introduced between the clamping bars. However, in the case of large sacks and with the weight of the carrying frame that is necessary for lifting same, impossibly high exertions would be required of the operator. Further, it would be essential for the clamping bars to be resiliently movable towards one another, this likewise being impossible if the known carrying frame had to be of sturdier construction.

It is therefore a problem of the present invention to provide an apparatus of the aforementioned kind for lifting filled heavy sacks, which apparatus can be suspended from the hook of a crane and is operable without exertion.

According to the invention, this problem is solved in that a first clamping bar is disposed at the free end of one of two pairs of levers which are pivotable in the manner of tongs and the second clamping bar is secured to a pivotable link at the end of the other pair of levers, which link, after or near completion of the closing motion of the pairs of levers, revolves the second clamping bar about the first and can be locked in its pivoted position, and that one clamping bar can be slightly displaced parallel to itself towards the other clamping bar and that drives are provided for the pivotal motions. After pivoting the pairs of levers to their open position and lowering of the apparatus according to the invention onto the end of the sack, the gathered and flattened end of the sack is disposed between the clamping bars, whereupon the links holding the one clamping bar are pivoted so that the clamping bar held thereby is disposed above the other clamping bar in the closed position. The pairs of levers are then brought to their closed position. The end of the sack is thereby brought into intimate contact with the two clamping bars. By pivoting the pivoted links, the clamping bar held thereby is brought below the other clamping bar along a substantially semi-circular path, the end of the sack is slung about substantially the entire periphery of the now upper clamping bar, and the lower clamping bar or the gathered and flattened end of the sack is brought into contact with one wall of the sack. In this position the links are locked, i.e. secured against turning back unintentionally. By means of the apparatus according to the invention, one avoids the manual work that was hitherto necessary in order to sling the end of the sack about the clamping bars and thus the lifting and depositing of large sacks can take place fully automatically. Preferably, the pairs of levers have a common pivotal axis so as to produce a simple construction.

In a development of the invention, links are hinged in a crank-like manner to the levers of the pairs of levers, which links are actuated by bars which are arranged at both sides of the pairs of levers and act on the common pivotal axis of the links.

The bars are preferably raised and lowered by a common drive motor. In a further development of the invention, the pivoted links rotatably mounted on one pair of levers and holding one of the clamping bars are connected to a pinion which engages gear segments loosely mounted on the levers.

Further, levers may act on the gear segments, the bars that effect the pivotal motion of the pairs of levers running up against said levers in the closed position so that they connect in a simple manner the pivotal motion of the levers to the pivotal motion of the pivoted links holding the one clamping bar.

Desirably, the spacings of the common pivotal axis of the pairs of levers from the rotary axes of the pivoted links carrying the one clamping bar and from the axis of the other clamping bar are equal.

Advantageous other features of the invention are described in more detail in the subsidiary claims.

An example of the invention will now be described in more detail with reference to the drawing, wherein.

Figure 1:
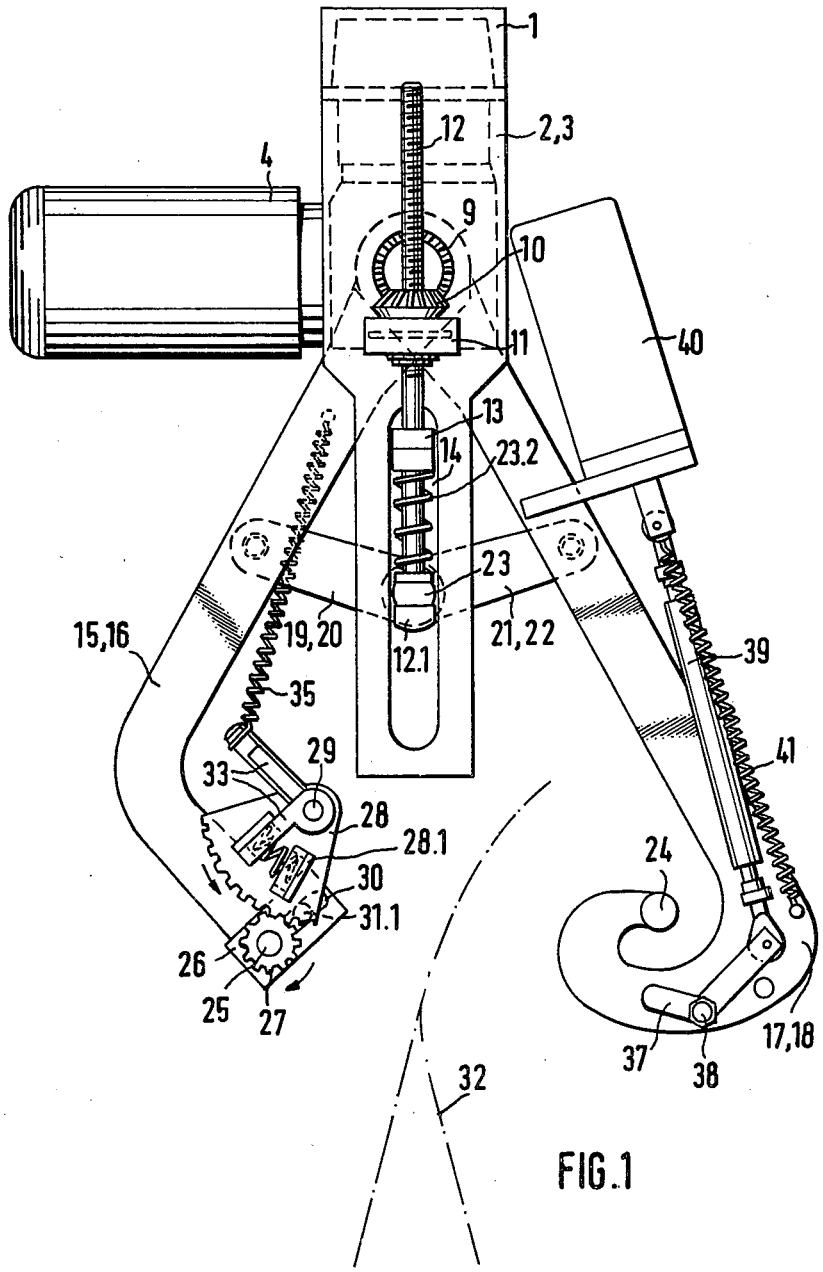
FIG. 1 is an end elevation of the apparatus in the open position.
Figure 2:
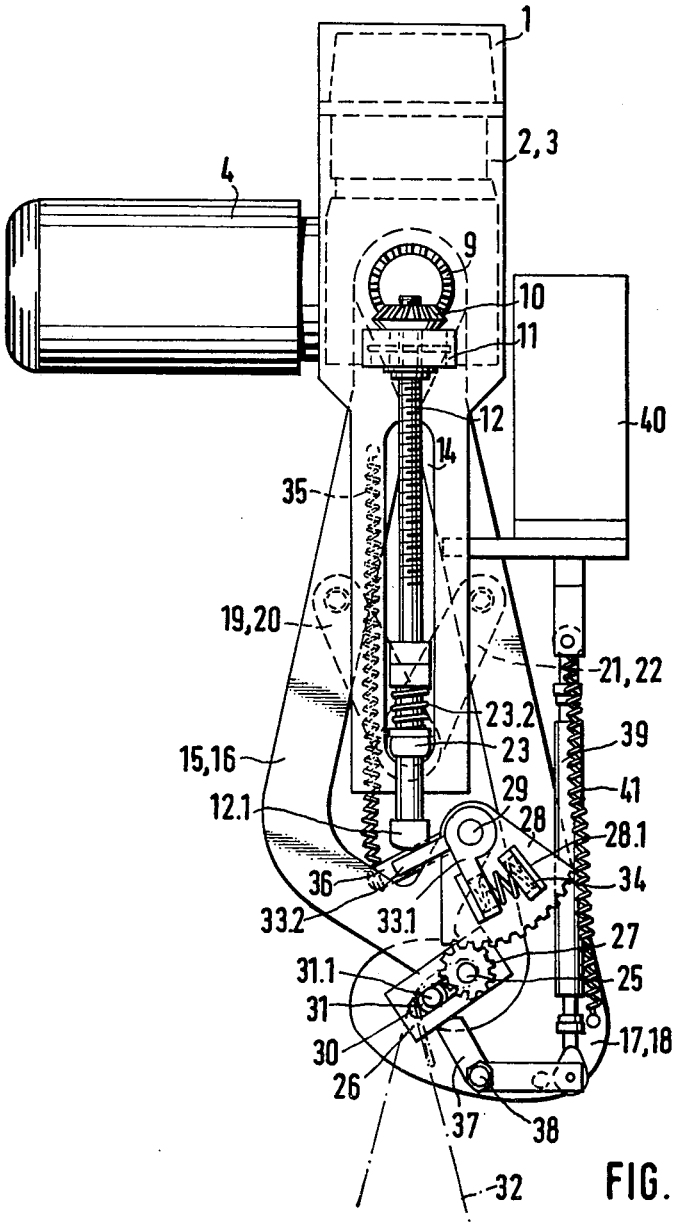
FIG. 2 is an end elevation in the closing position.
Figure 3:
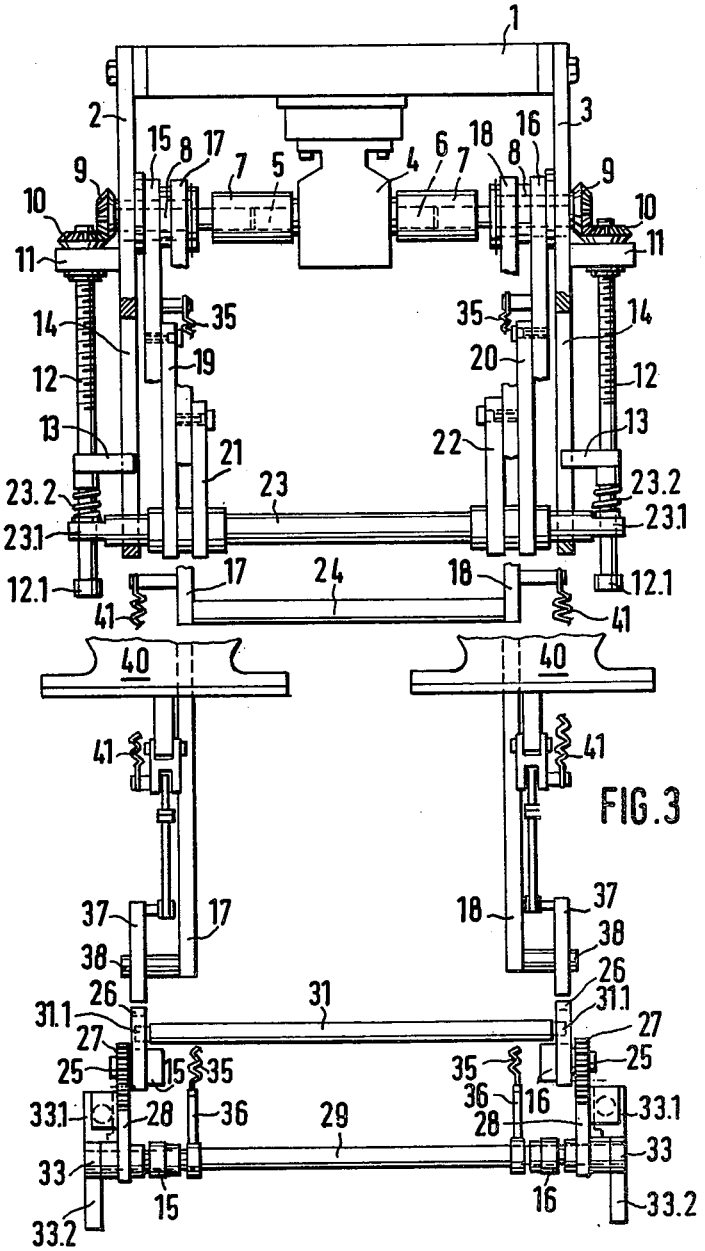
FIG. 3 is a front elevation of the apparatus.

Suspended from the hook (not shown) of a crane, there is a U-shaped cross-member 1 of which the ends are securely connected to side members 2 and 3. A gear motor 4 having two coaxial outputs 5, 6 is flanged to the cross-member 1. Connected to the outputs by way of clutches 7 there are shafts 8 which are rotatably mounted in the side members 2, 3 and have bevel gears 9 at their free ends. The latter engage with bevel gears 10 which are loosely rotatable in plummer blocks 11 secured to the side members 2, 3 but are held against displacement in the axial direction. The bevel gears 10 have tapped holes in which the screw-threaded ends of bars 12 are engaged. Welded to the bars 12 there are bearing blocks 13 which fit in grooves 14 milled into the side members 2, 3 to be parallel to the bars 12. Levers 15 to 18 are loosely rotatably mounted on the bearing sleeves for the shafts 8 secured to the side members 2, 3 the levers 15, 16 and 17, 18 each forming one pair of levers and the pairs 15, 16 being able to swing to the left and the pair 17, 18 away to the right. Links 19, 20 are hinged to the levers 15, 16 and links 21, 22 are hinged to the levers 17, 18. The free ends of the links 19 to 22 are pivoted to a shaft 23 of which both ends are guided in the grooves 14 of the side members 2, 3 and project outwardly beyond the side members 2, 3. They have holes 23.1 in which the bars 12 run. Compression springs 23.2 act between the bearing blocks 13 and the shaft 23. The bars 12 have abutment heads 12.1 which carry along the shaft 23 when the bars 12 are raised, whereby the pairs of levers 15, 16 and 17, 18 are swung to the open position shown in FIG. 1 by way of the links 19 to 22. Upon lowering of the bars 12, the compression springs 23.2 ensure that the shaft 23 is lowered and the pairs of levers 15 to 18 can be swung to a closed position shown in FIG. 2. The free ends of the levers 17, 18 are arcuately bent and securely connected to the two ends of a clamping bar 24.

Pins 25 on which the pivoted links 26 are loosely rotatable are secured to the free ends of the levers 15, 16. Secured to the pivoted links 26 there are pinions 27 engaging the gear segments 28 which are securely connected to a shaft 29 loosely rotatable in the levers 15, 16. The gear ratio between the pinions 27 and the gear segments 28 is approximately 1:4. The pivoted links 26 comprise centrallongitudinal grooves 30 which are disposed on the radius vector through the pin 25 and in which the pins 31.1 machined at the ends of a clamping bar 31 are guided. By turning the gear segments 28, therefore, the clamping bar 31 can be revolved about the axis of the pins 25. The spacings between the shafts 8 or the common pivotal axis of the lever 15 to 18 and the axes of the pins 25 as well as the axis of the clamping bar 31 are equal, so that in the closed position of the pairs of levers 15, 16 and 17, 18 the clamping bar 31 is moved around the clamping bar 24 by appropriate pivoting of the pivoted links 26, and the end of a sack 32 located between the levers 15 to 18 when in the open position is slung about the clamping bar 24 almost completely and about half of the clamping bar 31. By means of the longitudinal grooves 30, the spacing of the two clamping bars from one another is automatically set to conform to the thickness of the end 32 of the sack. The effective length of the clamping bar 24 is shorter than that of the clamping bar 31 so that the levers 17, 18 are disposed within the levers 15, 16 in the closed position.

The edges of the levers 17, 18 facing the clamping bar 24 are shaped so that, with an increasing pivoting angle, the clamping bar 31 is guided towards the clamping bar 24 and the end of the sack 32 engaged thereby is pressed against the clamping bar 24.

Two-armed levers 33 are loosely rotatably mounted on the ends of the shaft 29, their one lever arm 33.1 acting on compression springs 34 which are stressed between spring bearings 28.1 secured between the lever arms 33.1 and the gear segments 28 and which permit slight turning back of the pivoted links 26 when the sack 32 is lifted. The other lever arms 33.2 of the two-armed levers 33 are acted on by the abutment heads 12.1 in so far that, after the shaft 23 has reached its limiting position by abutting the lower end of the grooves 14, the bars 12 are lowered further by rotation of the bevel gears 9, 10.

By actuating the bars 12, therefore, the pairs of levers 15 to 18 are first brought to the closed position and as they are lowered further the clamping bar 31 is revolved about the clamping bar 24 so that the sack 32 is engaged and can be lifted. Upon reversed motion of the bars, the clamping bar 31 is first swung back upwardly about the clamping bar 24 and the pairs of levers 15 to 18 are thereupon moved to the open position so that the sack is released again.

The pivotal motion of the gear segments 28 on lifting the bars 12 is effected by tension springs 35 secured by one end to the side members 2, 3, the other ends engaging pins 36 secured to the shaft 29. To avoid return pivotal motion of the pivoted links 26 when the lifting gear loaded by a sack 32 is raised, locking levers 37 are provided on the levers 17, 18. The locking levers are loosely rotatably mounted on pins 38 secured to the levers 17, 18. In the locked position, the line of contact between the locking lever 37 and pivoted lever 26 is on a line joining the axes of the clamping bar 31 and the pins 38. The locking levers 37 are connected by intermediate bars 39 to the pull armatures of magnets 40. After energisation of the magnets 40, their armatures are attracted and the locking levers 37 are pivoted away from the pivotal radius of the pivoted links 26. Tensile springs 41 between the armatures and the levers 17, 18 swing the locking levers 37 to the locked position.

What is claimed is:

1. Apparatus for lifting filled sacks, comprising a pair of parallel clamping bars in which the gathered and flattened end of the sack can be inserted to envelop same, characterised in that a first clamping bar (24) is disposed at the free end of one of two pairs of levers (15, 16; 17, 18) which are pivotable in the manner of tongs and the second clamping bar (31) is secured to pivotable links (26) at the end of the other pair of levers (15, 16), which links, after or near completion of the closing motion of the pairs of levers (15 to 18), revolve the second clamping bar (31) about the first (24) and can be locked in their pivoted position, and that one clamping bar (31) can be slightly displaced parallel to itself towards the other clamping bar (24) and that drives are provided for the pivotal motions.

2. Apparatus according to claim 1, characterised in that the pairs of levers (15 to 18) have a common pivotal axis.

3. Apparatus according to claim 2, characterised in that links (19 to 22) are hinged in a crank-like manner to the levers (15 to 18) of the pairs of levers, which links are actuated by bars (12) which are arranged at both sides of the pairs of levers (15 to 18) and act on the common pivotal axis of the links (19 to 22).

4. Apparatus according to claim 3, characterised in that the bars (12) are raised and lowered by a common drive motor (4) and spindle drives.

5. Apparatus according to claim 1, characterised in that the pivoted links (26) rotatably mounted on one pair of levers (15, 16) are connected to pinions (27) which engage gear segments (28) loosely mounted on the levers (15, 16).

6. Apparatus according to claim 2, characterised in that the spacings of the common pivotal axis (8) of the pairs of levers (15, 16 and 17, 18) from the rotary axes of the pivoted links (26) carrying the one clamping bar (31) and from the axis of the clamping bar (24) are equal.

7. Apparatus according to claim 5, characterised in that links (19 to 22) are hinged in a crank-like manner to the levers (15 to 18) of the pairs of levers, which links are actuated by bars (12) which are arranged at both sides of the pairs of levers (15 to 18) and act on the common pivotal axis of the links (19 to 22), and characterised in that levers (33) act on the gear segments (28), the bars (12) that effect the pivotal motion of the pairs of levers (15 to 18) running up against said levers (33) in the closed position.

8. Apparatus according to claim 1, 5, or 7, characterised in that pins (38) on which locking levers (37) are loosely rotatably mounted are secured to the levers (17,18).

9. Apparatus according to claim 8, characterised in that the locking levers (37) are actuated by magnets (40).

10. Apparatus according to claim 1, 2, 3, 4, 5, 6, or 7, characterised in that the edges of the levers (17,18) facing the clamping bar (24) are shaped so that, with an increase in the pivoting angle, the clamping bar (31) is led towards the clamping bar (24) and the end of the sack (32) engaged thereby is pressed against the clamping bar (24).

* * * * *